United States Patent [19]

Perucchi

[11] Patent Number: 4,780,583

[45] Date of Patent: Oct. 25, 1988

[54] ROTATABLE CIRCULAR SWITCH

[75] Inventor: Norbert Perucchi, St. Blaise, Switzerland

[73] Assignee: Paolo Spadini, Geneva, Switzerland

[21] Appl. No.: 915,014

[22] Filed: Oct. 3, 1986

[30] Foreign Application Priority Data

Oct. 4, 1985 [CH] Switzerland ..... 4311/85

[51] Int. Cl.[4] ..... H01H 19/58

[52] U.S. Cl. ..... 200/292; 200/336; 200/11 DA; 200/11 G; 200/275

[58] Field of Search ..... 200/292, 11 R, 11 A, 200/11 K, 11 G, 11 DA, 252, 275, 257, 260, 236, 6 R, 6 C, 155 R

[56] References Cited

U.S. PATENT DOCUMENTS

| | | | |
|---|---|---|---|
| 1,739,003 | 12/1929 | Klingensmith | 200/11 A |
| 1,820,937 | 9/1931 | Cawley | 200/11 R |
| 2,079,003 | 5/1937 | Dick | 200/11 G |
| 2,340,615 | 2/1944 | Rath | 200/67 DA |
| 2,701,475 | 2/1955 | Readeker | 200/67 D |
| 3,024,334 | 3/1962 | Rhodes | 200/11 K X |
| 3,801,753 | 4/1974 | Szymber | 200/11 DA |
| 3,869,586 | 3/1975 | Patz et al. | 200/11 G |
| 3,970,986 | 7/1976 | Seyler et al. | 200/11 G X |
| 4,019,037 | 4/1977 | Monna | 200/155 R X |
| 4,400,597 | 8/1983 | Bruder et al. | 200/11 G X |

FOREIGN PATENT DOCUMENTS

| | | | |
|---|---|---|---|
| 1215800 | 5/1966 | Fed. Rep. of Germany | 200/11 A |
| 1549670 | 12/1968 | France | 200/11 R |

OTHER PUBLICATIONS

IBM Technical Disclosure Bulletin, vol. 27, No. 4B, Sep. 1984.

*Primary Examiner*—Henry J. Recla
*Assistant Examiner*—Ernest G. Cusick
*Attorney, Agent, or Firm*—Marks Murase & White

[57] ABSTRACT

An electrical switch suitable for a miniature apparatus such as a wristwatch comprises a resilient contact plate which is mounted on a member capable of rotating about an axis. The contact plate has two arms which extend radially from a rigid or mounted central portion. The outer ends of the arms are supported on a contact member, the arms being elastically deformed by the action of the contact forces. The two arms have different lengths and they are weakened in a different manner by apertures at their mounting location. Consequently, it is possible to achieve ideal compensation for the couples produced by the contact forces. In addition, an ideal deformation of the arms of the contact plate is obtained, as well as a well-defined position for the bearing points of the contacts.

2 Claims, 2 Drawing Sheets

ROTATABLE CIRCULAR SWITCH

BACKGROUND OF THE INVENTION

1. Field of the Invention

The present invention relates to electrical switches for miniaturized apparatuses such as wristwatches.

2. Related Art

The provision of electrical switches which are controlled by a miniaturized apparatus for example, a wristwatch presents certain difficulties, particularly with regard to friction, energy and dimensions. A conventional and flat arrangement provided by a rectilinear or helical plate is simple but inadequate in use, because it creates torque and extraneous frictional phenomena and requires an excessive consumption of energy from the power source (typically a battery).

Electrical switches are known comprising a flat and thin circular contact, formed from a partially insulated disc, capable of rotating about an axis and at least one slidable contact plate supported on the disc and having at least two arms supported on the disc at different points. However, known switches of this type are not entirely satisfactory for reasons which will be explained hereinafter.

The present invention seeks to provide an extremely thin electrical switch which does not create an interfering torque on its axis and which is particularly intended for controlling time-related functions.

SUMMARY OF THE INVENTION

According to the present invention an electrical switch is provided comprising a flat and thin circular contact capable of rotating about an axis. The switch is formed from a partially insulated disc and at least one slidable plate supported on the disc. The plate comprises at least two arms of different lengths which are supported on the disc at different points. The arms have a reduced cross-section near their mounting point such that, when they are in their working position, their profiles are substantially straight. And the resultant of their respective couples, which tend to create rotations in planes containing the axis, is substantially zero.

Conceived in another fashion, the present invention renders in a low-profile electrical switch comprising a first member having a substantially planar surface with an insulating region and a conducting region, and a rotatable contact member having a first arm and a second arm in mechanical compression with the planar surface. The first arm and second arm are mechanically connected and arranged to rotate about a common axis substantially normal to said planar surface. The arms extend in opposed directions from the axis, and are of different lengths. One of the arms is provided with a contact for contacting said conducting region. The first and second arms are configured so that a quantity defined as a product of moment of inertia and modulus of elasticity is the same for each despite being different in length, so that the mechanical compression produces substantially no net force tending to tilt said axis out of perpendicularity with the surface.

BRIEF DESCRIPTION OF THE DRAWINGS

Additional features of the invention will be explained in detail hereinafter with reference to the accompanying drawings, in which.

DETAILED DESCRIPTION OF THE PREFERRED EMBODIMENTS

Figure 1:
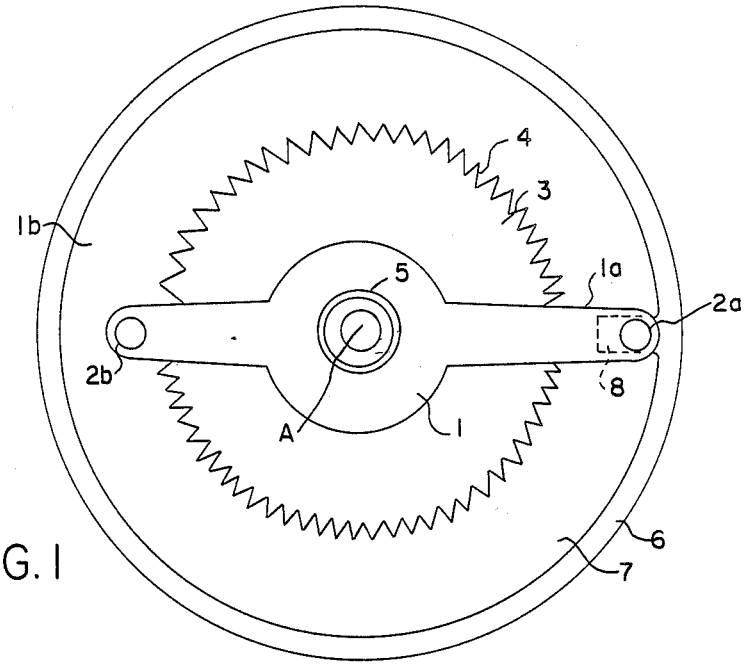
FIGS. 1 to 3 illustrate an arrangement for a switch.
Figure 2:
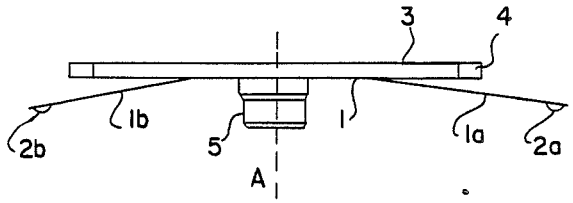
Figure 3:
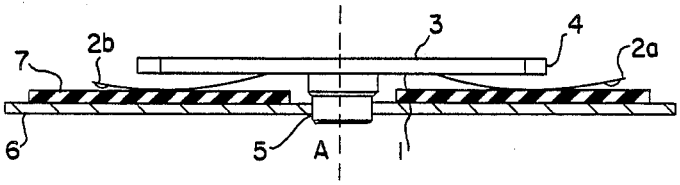
Figure 5:
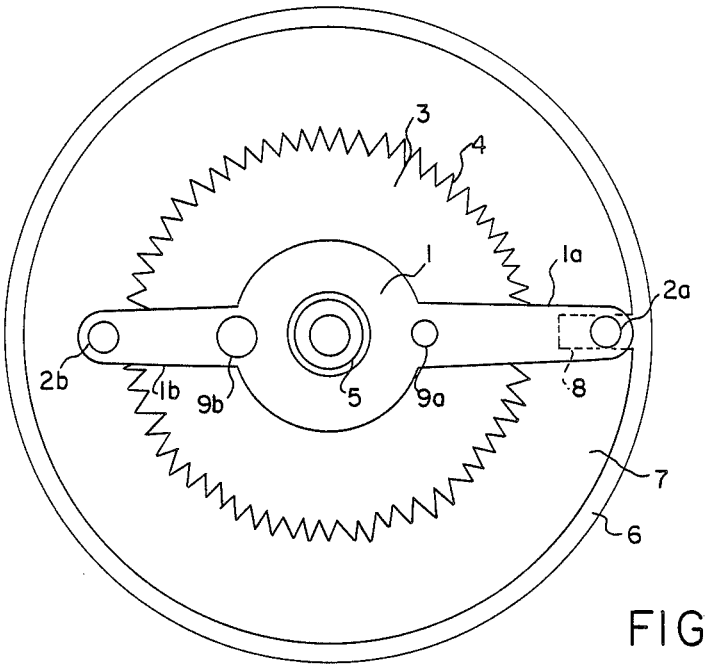
FIGS. 5 and 6 illustrate an embodiment in accordance with the invention.
Figure 6:
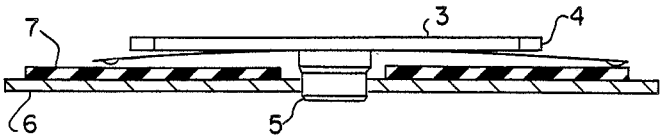

The component parts of the switches shown in FIGS. 1 to 3, and in FIGS. 5 and 6, respectively, are denoted by the same reference numerals. Each switch includes a contact plate 1 having two arms 1*a* and 1*b* having contacts 2*a* and 2*b*, respectively, at their ends. The plate 1 has an aperture in the center, and its central portion is mounted between a moving part 3, which has a toothed edge 4, and a barrel 5. When the apparatus—an electronic wristwatch, for example—is in its assembled state, the plate 1 and barrel 5 are mounted at a predetermined distance relative to a metal disc 6, which is schematically shown in FIG. 3. The metal disc 6 is covered by an insulating disc 7 of insulating material on the inside, with the exception of an island 8, which extends radially inwardly. It can be clearly seen, especially in FIG. 1, that the arm 1*a* is longer than the arm 1*b*, i.e. the distance of the contact 2*a* from the axis A of the switch is greater than the distance of the contact 2*b* from the axis A. Thus, the contact 2*a* is capable of coming into contact with the conducting island 8 of the disc 6, while the contact 2*b* is always situated on the insulating portion 7. The switch is closed, therefore, when the contact 2*a* slides onto the island 8 during rotation of the contact plate 1 together with the moving part 3 which is, for example, the wheel governing the hour wheel of the watch.

FIG. 2 shows the form of the contact plate 1 without an external load, i.e. prior to assembly. FIG. 3 shows the position and form of the contact plate after assembly of the apparatus.

The embodiment in accordance with the invention, which is shown in FIGS. 5 and 6, is distinguished from the arrangement shown in FIGS. 1 to 3 by the fact that the cross-section of the contact plate 1 is reduced at the location where its arms are mounted by means of apertures 9*a* and 9*b*, respectively. The quasi-circular central portion of the contact plate 1 is virtually rigid and the elastic deformation of the contact plate in its assembled state is substantially restricted by the arms 1*a* and 1*b*. It is clearly seen from FIG. 5 that the aperture 9*a* in the longer arm 1*a* is smaller than the aperture 9*b* in the arm 1*b*. Thus, the reduction in the cross-section, and necessarily, moment of inertia of the contact 2*a* is smaller than the reduction in the contact 2*b*.

Figure 4:
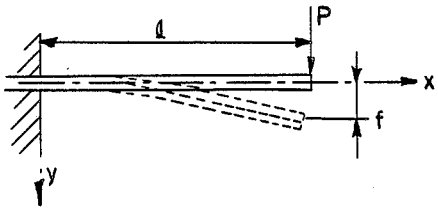
FIG. 4 illustrates the deformation phenomena of the arms of a contact plate.

The deformation phenomena of the contact plates shown will be explained and compared with reference to FIG. 4.

When a plate, which is mounted at one end, is stressed at the other end, the elementary formula for the resistance of the materials permit the following calculations to be made in dependence upon the stress P:

the form of the compressed plate is calculated by the formula $$y = \frac{Pl^3}{2EI}\left(\frac{x^3}{3l^3} - \frac{x}{l}\right); \text{ and} \qquad 1$$

the maximum deflection at the end x=

$$f=(Pl^3/3EI) \qquad 2.$$

where

I: moment of inertia of the cross-section of the plate; and

E: modulus of elasticity of the plate.

It is ascertained, therefore, that, all other features being equal, for an identical compression f, a short plate will have to be stressed more strongly than a long plate.

It is obvious that, by the action of the bearing force P of the plate, a couple C is created between the two component parts (moving part and disc), thereby stressing these moving parts in the plane of their axis, and this may be the reason for faulty operation. To eliminate this disadvantage, the device is constructed to be symmetrical by compensating for the couple C by another opposing couple, due to an opposite plate.

In order not to double the number of contacts per rotation and in order not to have to insulate the second plate, the solution description may possibly be provided by the introduction of a shorter plate which has a friction path passing outside the contact island 8. If the two plates have identical characteristics, apart from their length, the shorter plate will exert, for an identical deformation, a bearing force which differs from that of the longer plate. Consequently, there is only partial compensation, and the above-mentioned problem is only slightly improved, if at all.

A solution, which is only valid in a well-defined case, may be found by adjusting plates of identical cross-section in such a manner that, for the nominal working conditions, the respective degrees of compression f are different, the couples c themselves being identical.

This solution only resolves the problem in the particular case of nominal working conditions, because if, by reason of the manufacturing tolerances, the distance between the moving part and the disc happened to change, the bearing forces P would vary by different amounts.

The ideal solution which, moreover, presents another considerable advantage—as will be apparent hereinafter—resides in weakening the two plates differently at the locations where the stress, hence the deformation, is at its maximum.

FIG. 3 shows the contact spring of FIGS. 1 and 2 in its working position. It can be seen that, because of the deformation of the arms, the points of contact with the disc are not those which had been envisaged. The application of formula 1 above permits the forms of the deformed plates to be traced theoretically and proves that, especially in the case of small thicknesses, the bearing point may vary greatly, for small differences in the total height.

As can be proved by applying formula 2, a weakening in a given zone causes a greater deformation in this zone. This deformation will be increased if the weakening is achieved at the location of maximum stress. The maximum effect is therefore achieved if the weakening occurs at the mounting point.

It is possible, therefore, to achieve a contact spring (FIGS. 5 and 6) with its two plates weakened by differing amounts in the respective mounting zones. The weakening may be accomplished, for example, by providing two apertures of different diameters, as shown in FIG. 5. These weakened zones are dimensioned with reference to formulae 1 and 2 so that almost the entire deformation is produced in these zones. Thus, the bearing point remains perfectly defined whatever the deformation, as shown in FIG. 6.

On the other hand, by dimensioning these weakenings in a judiciously different manner, the bearing forces may become equal or the extraneous couples may be compensated for.

It is self-evident that the weakening must be calculated so that the maximum tolerable stresses of the plate material are not exceeded.

There are several possible variations from the embodiment shown. It would be possible to envisage a contact plate with more than two arms, but such must be symmetrical to obtain total compensation for the couples acting on the axis. The weakened or reduced cross-section of the arms may be achieved by other measures. It is possible, for example, to weaken the arms by providing symmetrical external notches. Instead of having circular apertures, it is also possible to envisage oblong apertures which are situated substantially in the center of the width of the arms. It is further possible to provide reductions by reducing the thickness of the plate in the vicinity of the mounting points.

It is apparent from the foregoing that a new and improved construction for an electrical switch has been provided. While only a preferred embodiment has been described in detail, as will be apparent to those skilled in the art, certain changes and modifications can be made without departing from the spirit and scope of the invention as set forth in the following claims.

What is claimed is:

1. An electrical switch comprising:

an insulated disc having an island of conductive material disposed thereon; and a plate member rotatably secured to said disc, said plate member having a central portion and comprising:

a first arm of a first length and a first width, said first length extending radially from said central portion and said first arm being adapted to contact said disc, whereby a first force is induced in said first arm when said first arm contacts said disc;

a second arm of a second length and a second width different from said first length and first width, said second length extending radially from said central portion, said second arm being adapted to contact said island of said disc, whereby a second force is induced in said second arm when said second arm contacts said disc; and a first aperture means formed in said first arm at a midpoint of said first and a second aperture means different in size from said first aperture means formed in said second arm at a midpoint of said second width, said first aperture means and second aperture means being for balancing said first force and second force, respectively, whereby a net tilting force on said plate is substantially zero and whereby said first and second arms maintain substantially linear profiles when contacting said disc.

2. A switch according to claim 1, wherein said first and second aperture means comprise first and second circular recesses, respectively; and wherein said second recess has a diameter slightly greater than said first recess.

* * * * *

UNITED STATES PATENT AND TRADEMARK OFFICE

CERTIFICATE OF CORRECTION

PATENT NO. : 4,780,583

DATED : October 25, 1988

INVENTOR(S) : Norbert Perucchi

It is certified that error appears in the above—identified patent and that said Letters Patent is hereby corrected as shown below:

Claim 1, line 52, after "first", insert -- width --.

Signed and Sealed this

Fourteenth Day of March, 1989

*Attest:*

DONALD J. QUIGG

*Attesting Officer*

*Commissioner of Patents and Trademarks*